US011497320B2

(12) United States Patent
Sheikh

(10) Patent No.: US 11,497,320 B2
(45) Date of Patent: Nov. 15, 2022

(54) DUAL FIRMNESS SPRING MATTRESS

(71) Applicant: Layla Sleep, Inc., New Haven, CT (US)

(72) Inventor: Akrum Sheikh, Orange, CT (US)

(73) Assignee: Layla Sleep, Inc., New Haven, CT (US)

( * ) Notice: Subject to any disclaimer, the term of this patent is extended or adjusted under 35 U.S.C. 154(b) by 23 days.

(21) Appl. No.: 16/945,828

(22) Filed: Aug. 1, 2020

(65) Prior Publication Data

US 2022/0031085 A1 Feb. 3, 2022

(51) Int. Cl.
*A47C 27/14* (2006.01)
*A47C 21/04* (2006.01)
*A47C 27/15* (2006.01)

(52) U.S. Cl.
CPC ..... *A47C 27/148* (2013.01); *A47C 21/046* (2013.01); *A47C 27/15* (2013.01)

(58) Field of Classification Search
CPC ..... A47C 27/148; A47C 27/15
See application file for complete search history.

(56) References Cited

U.S. PATENT DOCUMENTS 1,371,362 A 3/1921 Giese
3,110,042 A 11/1963 Slemmons
3,534,471 A 10/1970 Boyles
3,939,508 A 2/1976 Hall
4,286,344 A 9/1981 Ikeda
4,449,261 A * 5/1984 Magnusson ..... A47C 21/044 5/722
4,476,594 A 10/1984 McLeod
4,726,083 A 2/1988 Hoshall
4,829,515 A 5/1989 Raymond
4,901,387 A 2/1990 Luke
5,259,079 A 11/1993 Visser
5,504,953 A * 4/1996 Singer-Leyton ..... A47C 27/15 5/631
5,701,623 A 12/1997 May
(Continued)

FOREIGN PATENT DOCUMENTS

DE 202010007011 U1 * 8/2011 ..... A47C 27/148
DE 202013104359 U1 * 10/2013 ..... A47C 27/15
(Continued)

OTHER PUBLICATIONS

Big Fig Mattress "https://www.bigfigmattress.com/the-big-fig" (Year: 2017).*

*Primary Examiner* — David R Hare
*Assistant Examiner* — Alexis Felix Lopez
(74) *Attorney, Agent, or Firm* — Welsh IP Law LLC

(57) ABSTRACT

A flippable mattress includes a first memory foam layer, a second memory foam layer, a core layer disposed therebetween and a transition layer between each foam layer and the core. The first memory foam layer has a thickness, and the second memory foam layer has a thickness that is greater than the thickness of the first memory foam layer. The first transition layer has an IFD less than that of the second transition layer. The mattress is flippable between a first orientation in which the first memory foam layer is above the core layer and the second memory foam layer, and a second orientation in which the second memory foam layer is above the core layer and the first memory foam layer.

16 Claims, 7 Drawing Sheets

(56) References Cited

U.S. PATENT DOCUMENTS

| | | | | |
|---|---|---|---|---|
| 5,953,779 | A | 9/1999 | Schwartz | |
| 6,115,861 | A | 9/2000 | Reeder | |
| 6,286,166 | B1 * | 9/2001 | Henley | A47C 27/001 5/722 |
| 6,481,033 | B2 | 11/2002 | Fogel | |
| 6,848,130 | B1 | 2/2005 | Wilson | |
| 7,086,108 | B1 | 8/2006 | Litvak | |
| 7,340,788 | B1 | 3/2008 | Traub | |
| 9,877,591 | B2 * | 1/2018 | Morgan | A61G 7/05715 |
| 10,477,979 | B2 * | 11/2019 | Jewett | A47C 27/05 |
| 10,531,746 | B2 * | 1/2020 | Vesey | A47C 27/06 |
| D898,464 | S | 10/2020 | Sheikh | |
| 2001/0027596 | A1 | 10/2001 | Suppawat | |
| 2003/0221262 | A1 | 12/2003 | Torbet | |
| 2004/0181879 | A1 * | 9/2004 | Prince | A47D 15/001 5/690 |
| 2005/0034241 | A1 | 2/2005 | Prince | |
| 2006/0016003 | A1 | 1/2006 | Garrigues | |
| 2008/0098533 | A1 * | 5/2008 | Erdman | A47C 31/105 5/722 |
| 2008/0154670 | A1 | 6/2008 | McAlhaney | |
| 2008/0201856 | A1 | 8/2008 | Hunter | |
| 2008/0229507 | A1 * | 9/2008 | Healy | A47C 27/15 5/691 |
| 2008/0256706 | A1 | 10/2008 | Larsen | |
| 2010/0058541 | A1 | 3/2010 | Kemper | |
| 2010/0170042 | A1 | 7/2010 | Rose | |
| 2011/0252572 | A1 * | 10/2011 | Morrison | A47C 27/144 5/740 |
| 2015/0182031 | A1 * | 7/2015 | Jensen | A47C 21/00 5/690 |
| 2015/0187233 | A1 * | 7/2015 | Jensen | G09F 3/02 427/256 |
| 2017/0325597 | A1 * | 11/2017 | Carlitz | A47C 27/15 |
| 2019/0298076 | A1 * | 10/2019 | Lim | A47C 21/046 |
| 2019/0365117 | A1 * | 12/2019 | Schwartz | A47C 27/085 |
| 2019/0380502 | A1 * | 12/2019 | Eigenmann | A47C 27/07 |
| 2020/0288874 | A1 * | 9/2020 | Jewett | A47C 27/064 |
| 2020/0360210 | A1 * | 11/2020 | Zoni, III | A47C 27/127 |
| 2021/0022518 | A1 * | 1/2021 | Chapin | A47C 27/085 |
| 2021/0235884 | A1 * | 8/2021 | Nolte | A47C 27/002 |

FOREIGN PATENT DOCUMENTS

| | | | | |
|---|---|---|---|---|
| DE | 202019102536 | U1 * | 5/2019 | A47C 27/144 |
| EP | 1902650 | A2 * | 3/2008 | A47C 27/16 |
| GB | 2244000 | B | 9/1993 | |
| GB | 2499630 | A * | 8/2013 | A47C 27/15 |
| GB | 2528513 | A * | 1/2016 | A47C 27/064 |
| WO | WO-2007149260 | A2 * | 12/2007 | A47C 27/12 |
| WO | WO-2013112840 | A1 * | 8/2013 | A47C 27/15 |
| WO | WO-2019156345 | A1 * | 8/2019 | A47C 27/15 |

* cited by examiner

DUAL FIRMNESS SPRING MATTRESS

TECHNICAL FIELD

The present invention relates to a flippable mattress comprising foam and spring layers.

BACKGROUND

A foam mattress typically includes at least a core layer and a memory foam layer (sometime referred to as a comfort layer). The core layer is made of a high-density foam and is designed to provide a supportive base for the mattress. The memory foam layer is made of a lower density foam and is designed to provide a comfortable sleeping surface. The core layer typically has a thickness that is substantially greater (e.g., at least 100% greater) than that of the memory foam layer.

Foam mattresses are typically designed for use in only one orientation in which the memory foam layer is above the core layer. Although a user would be free to flip the foam mattress to provide the core layer above the memory layer, virtually no user would do so. This is because the density of the core layer is typically so high that it would be prohibitively uncomfortable for use as a sleeping surface. For these reasons, foam mattresses are typically described as being "non-flippable" or "one-sided."

The popularity of foam mattress has increased recently due to advances in foam materials. The polyurethane memory foam that was traditionally used in mattresses has been replaced or supplemented with open cell (e.g., plant-based) memory foams and/or gel-infused memory foams. The main advantage of open cell and gel-infused memory foams is that they are more breathable than polyurethane memory foam, and thus they avoid the problem of overheating that users commonly experienced with polyurethane memory foam mattresses.

For example, US Publication No. 2010/0058541 discloses a reversible mattress comprising multiple layers of foam adhered together to form a unitary construction. The mattress comprises five foam layers including a single core. The outer layers and intermediate layers help prevent unwanted mattress sag, while the core layer provides adequate support. However, while "being able to retain much body heat" is implied to be a good thing in the '541 publication, most sleepers actually prefer cooling mattresses. The polyurethane foam is also a haven for bacteria and other microbials to collect and expand.

GB Patent No. 2,224,000 discloses a reversible multilayer foam mattress having different degrees of firmness on its opposite horizontal sides. The '000 patent discloses a mattress comprising three layers of plastic foam laminated together to form a rectangular block. The second, intermediate layer being made of an open cell plastics foam of density lying in the range of 33-40 kg/m$^3$ and hardness in the range 100-150 N. The outer layers are made from an open cell plastics foam having lower density and hardness.

US Publication No. 2010/170042 discloses a reversible laminated foam mattress having a center core of relatively high resilience sandwiched between two layers of lower resilience foam encased in a fabric shell. The two layers of foam encasing the core allows the mattress to be reversible. The multi-layered foam mattress is comprised of visco-elastic polyurethane foam, "memory foam", or foam rubber. The benefits of memory foam are that it closely conforms to the shape of the human body and can efficiently distribute pressure over the whole surface. It also has the ability to dampen vibration as well as to absorb shock.

Another reason that foam mattresses have become increasingly popular is that manufacturers developed techniques for compressing and packaging foam mattresses into relatively small cardboard boxes that are easily handled and cheaply delivered by major delivery services (e.g., UPS or FedEx). This has enabled a new online-only business model by which a manufacturer sells foam mattresses direct to consumers via a website. The manufacturer uses a delivery service (e.g., UPS, FedEx, etc.) to ship the compactly-packaged foam mattress directly to consumers' doorsteps. One problem with this online-only business model is that consumers are usually left with no opportunity to test a foam mattress before purchasing. To compete with companies that sell traditional spring mattresses from showrooms, foam mattress manufactures are forced to offer lengthy trial periods and free returns, the latter of which can be very expensive due to the fact that a technician must be dispatched to the consumers' location to assist with repackaging of a foam mattress for return shipping. Shipping is a huge cost associated with selling a mattress, and customers would be deterred from entering the free trial if they were still on the hook for shipping such a large item.

Consumer returns of foam mattresses are most often due to dissatisfaction with firmness. Therefore, free shipping both ways has become a staple of online mattress purchases. To reduce the number of consumer returns (and the high costs associated therewith), it would be advantageous to provide a flippable or two-sided foam mattress having a first side that is relatively firm, and an opposing second side that is relatively soft. However, such flippable or two-sided foam mattresses were thought to be impracticable due to the fact that memory foam layers would be needed both above and below the supportive core layer to allow for user comfort in both orientations of the mattress. It was thought that providing memory foam layers on both sides of the core layer would prohibitively reduce support and stability of the mattress, and/or increase the total thickness of the mattress beyond a maximum (e.g., approximately 20 inches or 50 cm) considered acceptable for use with typical bedframes.

Flippable mattresses often have handles to aid in transporting and flipping the mattress. Covers with soft stretchable material having an attached solid handle can often cause ripping at the seam of the handle. This is because the force exerted on the handle will often only be placed in a single direction against the stretchable fabric. This may happen while the mattress is being transported or flipped.

Aspects of the present invention are directed to these and other problems.

SUMMARY

According to an aspect of the present invention, a flippable mattress includes a first memory foam layer having a thickness, a second memory foam layer having a thickness that is greater than the thickness of the first memory foam layer, and a core layer that is disposed between the first memory foam layer and the second memory foam layer. The mattress is flippable between a first orientation in which the first memory foam layer is above the core layer and the second memory foam layer, and a second orientation in which the second memory foam layer is above the core layer and the first memory foam layer.

According to another aspect of the present invention, a system is provided that includes the above-mentioned flippable mattress and a cover disposed on at least a portion of the flippable mattress.

The cover may also have a handle attached to the outer surface of the mattress. The handles would aid in the transport and the flipping of the flippable mattress. To create a solid handle to grasp, the handle may be made out of vinyl or a similar material. The solid handle provides enough support to lift and flip the mattress. However, since the vinyl handle will be carrying a large amount of force, simply sealing the handle into the cover would often cause tears, rips, or holes to form in the cover. Therefore, in one object of the invention the handle may be attached to a non-stretchable durable fabric which would be integrated into the cover. Therefore, the handle has more points of contact with the cover, and will prevent ripping from the fabric attempting to stretch over the handle.

According to another aspect of the present invention, a flippable mattress consists of a plurality of foam layers, and adhesive between adjacent layers of the plurality of foam layers. The plurality of foam layers includes a first memory foam layer defining a first sleeping surface, and a second memory foam layer defining a second sleeping surface. The mattress is flippable between a first orientation in which the first memory foam layer is above the second memory foam layer, and a second orientation in which the second memory foam layer is above the first memory foam layer.

The foam layers may comprise copper infused memory foam. Copper infused memory foam has a lot of benefits over typical memory foam. The conductivity of copper allows it to quickly dissipate unwanted heat and wick water away from the surface to prevent accumulation. Copper is also anti-microbial, and therefore the copper infusion helps stymie bacteria or other growth on the surface or interior of the mattress.

Additionally, the mattress has transitional layers which provide more comfort to the sleeper. The first transitional layer is disposed between the first memory foam layer and the core and the second transitional layer is disposed between the second memory foam layer and the core. The transitional layers provide an extra barrier between the foam layers and the core.

The transitional layers are manufactured to have two surfaces, a substantially planar surface which faces the core and a surface having a plurality of peaks and valleys which face the transition layer's respective foam layer. The peaks and valleys may differ based on their location on the mattress. Each mattress has a head and a foot side as known by one skilled in the art.

The human body needs different amounts of support in the legs and head as opposed to the hips and back. Therefore, in one aspect of the invention, the transition layers may be designed such that the pattern is less forgiving around the foot and head of the bead and provide more cushion in the center of the layer. This would provide a foundation for the hips and back of the sleeper to fit in and provide for a more comfortable sleep.

In one aspect of the invention the center of the transition layer may have hexagonal shaped peaks and/or valleys and the foot and head of the transition layers may have diamond shaped peaks and/or valleys.

Since the transition layers are made with a plurality of peaks and valleys, varying the size of the layer to change the layer's firmness can be complicated and inefficient. For example, the peaks may lose a lot of tensile strength and fold the inconsistent patterns. Instead, the transition layers can be varied through changing the deflection of the layer.

The resistance to compression for resilient foam materials is measured by an Indentation Load Deflection (ILD) or Indentation Force Deflection (IFD) value. One skilled in the art would understand that these terms are used interchangeably in the art and within this specification. The foam density may be measured in pounds, or pounds per cubic foot. By varying the ILD of the transition layers, the peaks and valleys conform to the softness or firmness desired.

These and other aspects of the present invention will become apparent in light of the drawings and detailed description provided below.

DETAILED DESCRIPTION

Figure 1:
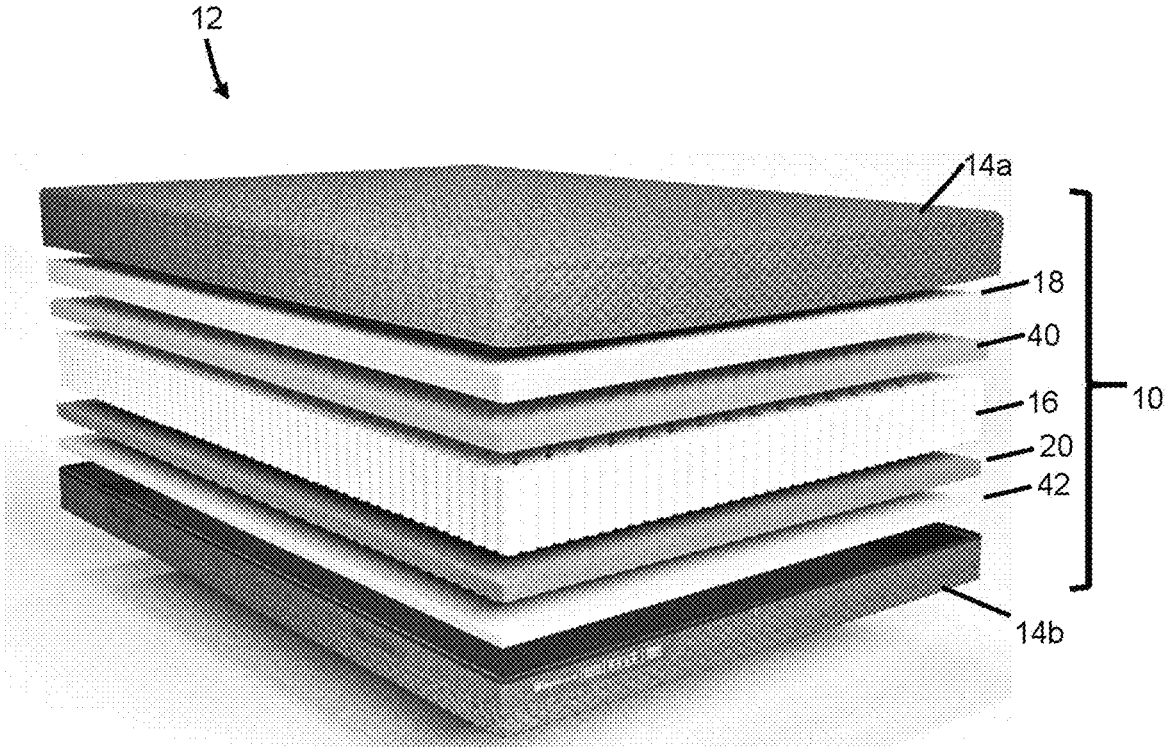
FIG. 1 is blown-out perspective view of the mattress.
Figure 2A:
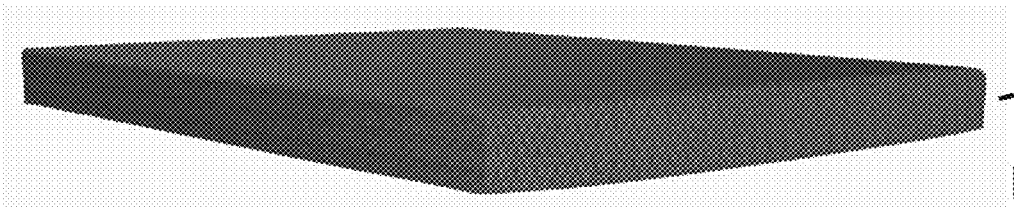
FIG. 2*a* is a perspective view of the top cover of the mattress.
Figure 2B:
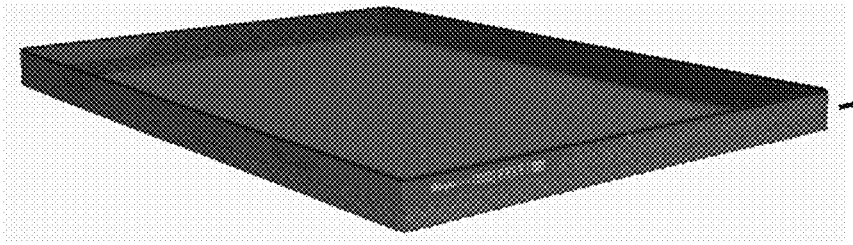
FIG. 2*b* is a perspective view of the bottom cover of the mattress.

Referring to FIGS. 1 and 2, the present disclosure relates to a flippable mattress 10, and a system 12 that includes the mattress 10 and a cover 14 disposed thereon. The cover 14 encloses the mattress 10, and is formed of a top shown in FIG. 2*a* and a bottom shown in FIG. 2*b*.

Figure 3:
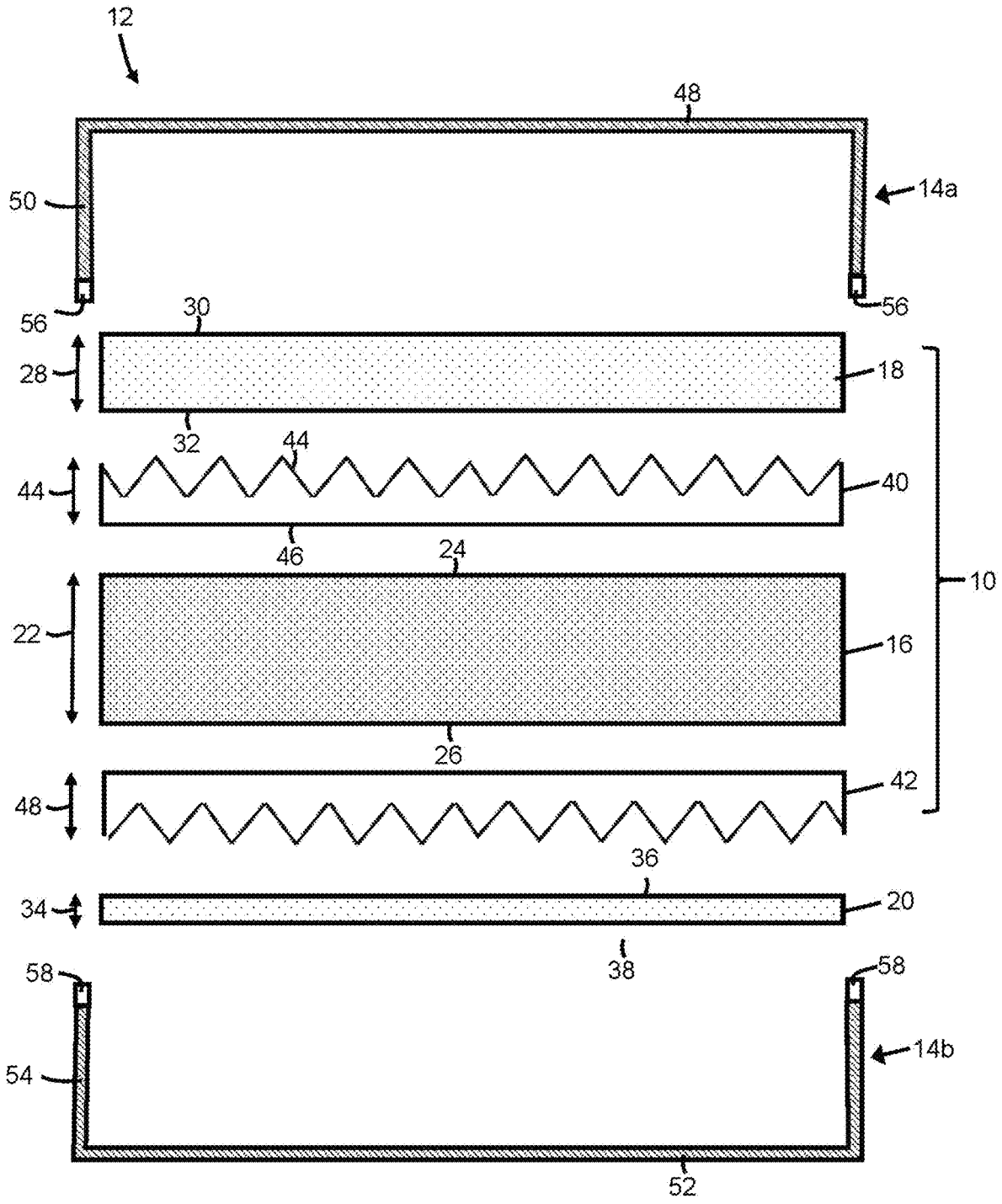
FIG. 3 is a cut away view of a blown-out view of the mattress.

Referring to FIG. 3, the mattress 10 includes a core layer 16, a first memory foam layer 18, and a second memory foam layer 20. The core layer 16 is disposed between the first memory foam layer 18 and the second memory foam layer 20. The core layer 16 has a thickness 22 defined between a first surface 24 and an opposing second surface 26 thereof. The first memory foam layer 18 has a thickness 28 defined between a first surface 30 and an opposing second surface 32 thereof. The second memory foam layer 20 has a thickness 34 defined between a first surface 36 and an opposing second surface 38 thereof. The thickness 28 of the first memory foam layer 18 is greater than the thickness 34 of the second memory foam layer 20. The mattress 10 is flippable between a first orientation and second orientation. In the first orientation (see FIG. 4), the first memory foam layer 18 is above the core layer 16 and the second memory foam layer 20. In the second orientation (see FIG. 5), the second memory foam layer is above the core layer 16 and the first memory foam layer 18. In the first orientation and the second orientation a proper sleep is obtainable on the mattress. This is in contrast to a typical mattress where two orientations are obtainable, however, in one orientation a proper sleep would be prohibited by a lack of comfort.

The cover 14 is disposed on at least a portion of the mattress 10. In the illustrated embodiment, the cover 14 houses an entirety of the mattress 10 therein. In other embodiments, the cover 14 is disposed on only a portion of the mattress 10.

The cover 14*a*, 14*b* may be made from a variety of materials. In one aspect of the invention the cover is made of a thermogel infused fabric material that aids in keeping a user cool during use of the system 12. The first cover portion 14*a* includes a first cover panel 48 and a first cover sidewall 50. The first cover panel 48 has a size and shape corresponding to the size and shape of the first surface 30 of the first memory foam layer 18. The first cover sidewall 50 extends perpendicularly from the first cover panel 48 along an entirety of an outer edge of the first cover panel 48. The second cover portion 14*b* includes a second panel 52 and a second sidewall 54. The second panel 52 has a size and shape corresponding to the size and shape of the second surface 38 of the second memory foam layer 20. The second sidewall 54 extends perpendicularly from the second panel 52 along an entirety of an outer edge of the second panel 52.

Since the cover is the outermost material on the mattress it is desirable to make it soft, however, in some aspects of this invention the cover is less soft to meet the tastes of customers. Therefore, the cover 14 may be made from a super soft fabric and may be breathable. The cover 14 may have a hexagon pattern sewn into it. The hexagons could be any size, however, a reduced size such as 0.75-inch hexagons would provide cost-effective comfort. Further, the hexagons may be different sizes on the top of the cover 14*a* verse the bottom of the cover 14*b*. The cover may be made from a blend of polyester, viscose, and poly/lycra. For example, the cover may be 66% polyester, 30% viscose, and 4% poly/lycra. It is advantageous for the cover to be water-proof or water-resistant, however, in some aspects of the invention the cover is neither water-proof nor water-resistant.

The cover may also have branding, warning, or other labels on its surface. Preferably, any branding, warning, label, or tag would be on the vertical sides of the mattress 12 to avoid discomfort. The labels may be made from Nylon or other materials. Advantageously, the cover would indicate to the user which side is the soft side and which side is the firm side. This could be done through a change in color from one side of the cover to the other, or though tags. For example, the soft side of the cover 14*a* may be white, while the firm side of the cover 14*b* may be dark gray.

The color difference between the two sides may give notice to the user which side is soft and firm and may also provide a psychological phenomenon to the user. For example, a soft sleeper may aesthetically prefer the softer side color and already believe they will enjoy the mattress before seeing it. In one object of the invention the mattress could be designed such that the soft side has a color typically associated with softness, e.g. white, baby blue, etc., the firm side may have a color more associated with firmness, e.g. dark gray, red, or black. In such an object of the invention, the user may make a personal connection to a particular side of the mattress, which would lead to a greater likelihood that they will sleep soundly.

It is also possible to distinguish the colors by their color coolness of warmness. In one object of the invention, the soft side of the cover may have a cooler color than the firm side. In another embodiment of the invention the firm side may have a cooler color than the soft side.

In another object of the invention, the mattress may use colors to depict the firmness or softness of a mattress side to emphasize the thickness of the layers. For example, if the soft memory foam was larger in size than the firm memory foam, the color depicting the soft side would cover more of the mattress vertically than the color depicting the firm side. This would give the user a visualization of the plush, or lack of plush, on their desired side. Seeing the plush nature depicted by color may allow the user to trust the feeling of the mattress, thus providing a calmer sleep.

The cover may also have a handle on the vertical surface for ease in transporting or flipping the mattress 12. The handle may be made from vinyl or another material. In another aspect of the invention, there may be a plurality of handles disposed around the flippable mattress 12.

Figure 10:
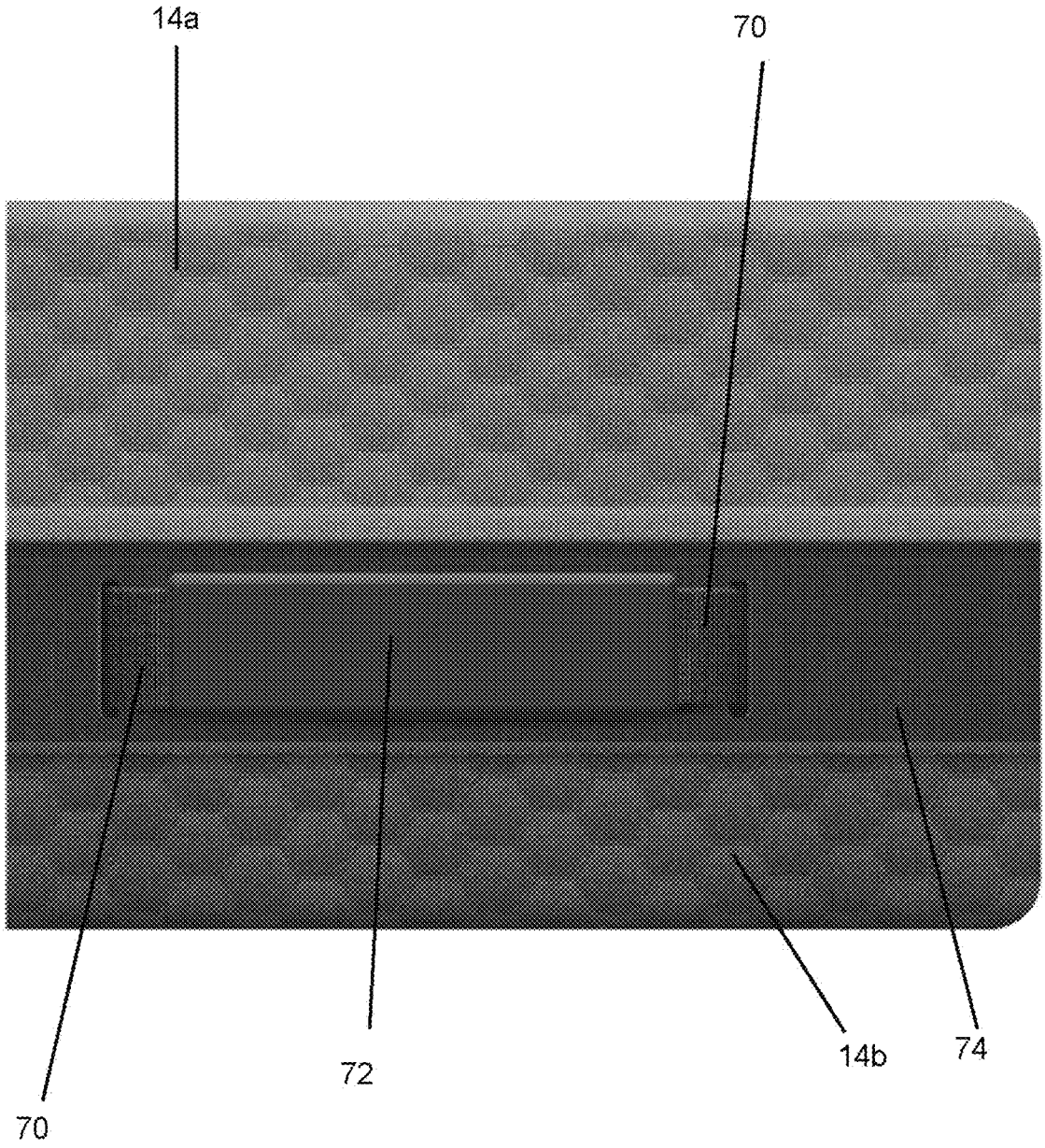
FIG. 10 depicts a portion of the mattress having a handle.

One object of the invention having a handle is shown in FIG. 10. The flap 74 folds over the cover 14*b*. The flap 74 is optional, but aesthetically allows a zipper or other connection between 14*a* and 14*b* to be hidden. In other objects of the invention, the flap may be laid over the cover 14*a*. The handle 72 may be made out of a vinyl material. In other objects of the invention the handle may be made of a different material. It is advantageous for the handle to be firm, to provide a better grip for a mover, however, the handle may also be soft.

The handle 72 may be attached to the stretchable cover 14*a* 14*b* by a secondary fabric 70. The secondary fabric 70 may be non-stretchable and durable. The secondary fabric 70 may be integrated into the cover 14*a* 14*b*. This integration may be only in the top of the cover 14*a*, only in the bottom of the cover 14*b*, or in both top and bottom of the cover. The integration of the secondary fabric 70 may be through stitching the secondary fabric into the cover 14. The secondary fabric 70 may be stitched into the cover 14 by only a slim portion of the secondary fabric 70. The secondary fabric 70 may also have a patch within the cover 14, such that the portion of the secondary fabric 70 extruding from the cover 14 only makes up a portion of the patch. In this object of the invention the secondary fabric will have multiple points of contact with the cover 14, thereby reducing the stress at any single point of contact. Since the force will be distributed over a larger portion of the cover 14 there is less of a chance that force exerted on the handle will cause the cover the rip or tear.

In another object of the invention, the handle 72 may be attached to the flap 74. This may be via a secondary fabric 70 or without the secondary fabric 70. The flap 74 also has many points of contact with the cover 14, therefore, would reduce the chance of ripping or tearing the cover.

In other objects of the invention the secondary fabric 71 may be of varied stretchability. Varied stretchability would allow for the secondary fabric 70 to be integrated into the cover 14 in larger amounts without removing more of the stretch functionality from the cover 14.

The top of the cover 14*a* may connect to the bottom of the cover 14*b* via a zipper 56, 58. Since the mattress is flippable, the terms top and bottom are relative to FIG. 1. It would be advantageous to hide the zipper 56, 58 within flaps to keep the zipper closed and for aesthetical or other technical purposes. The zipper flaps may automatically reveal the zipper 56, 58 as it pulled open. In other aspects of the invention the zipper 56, 58 may be a different type of fastener, for example: buttons, hook-and-loop, glue, or other fasteners which would be appreciated by one having ordinary skill in the art.

The first layer of the mattress 18 may be made from copper infused memory foam. They fifth layer 20 may also be made from copper infused memory foam. Copper infused memory foam has advantages over regular memory foam due to the conductive and anti-microbial nature of copper. The conductivity of the copper allows the memory foam to dissipate excess body heat, whereas other mattresses would trap the heat. Copper will also help wick and release water or other liquids quicker than typical memory foam. The anti-microbial nature of copper helps to limit bacteria growth and build up in the mattress. The memory foam infused with copper reacts under body weight with a firming response. The response is called Variable Support and unlike traditional memory foam provides increased support at deep compression areas. The memory foam layers combined with the coil layers provide advanced motion control throughout the mattress. This may help, for example, preventing movements from one side of the mattress from transitioning to the other side. Additionally, since the copper infused memory foam will react to body weight, it allows proper support for a sleeper no matter how they sleep, be it on their side, back, or stomach.

The Copper infused memory foam may have an IFD rating of about 12 lbs. The foams Density may be about 3.5 lbs. The first layer 18 is softer or equally as soft as the fifth layer 20. The soft feel of the first layer 18 relative to the fifth layer 20 comes from the thickness 28 of the first layer. A thicker copper infused memory foam layer will provide more softness, even for similar or identical densities and IFDs. The first layer 18, being the softer layer, may have a thickness 28 of 2-3 inches. In one aspect of the invention, the first layer 18 would have a thickness 28 of about 2.5 inches. The fifth layer 20, being the firmer layer, may have a thickness 34 of 0.75-1.5 inches.

Figure 6:
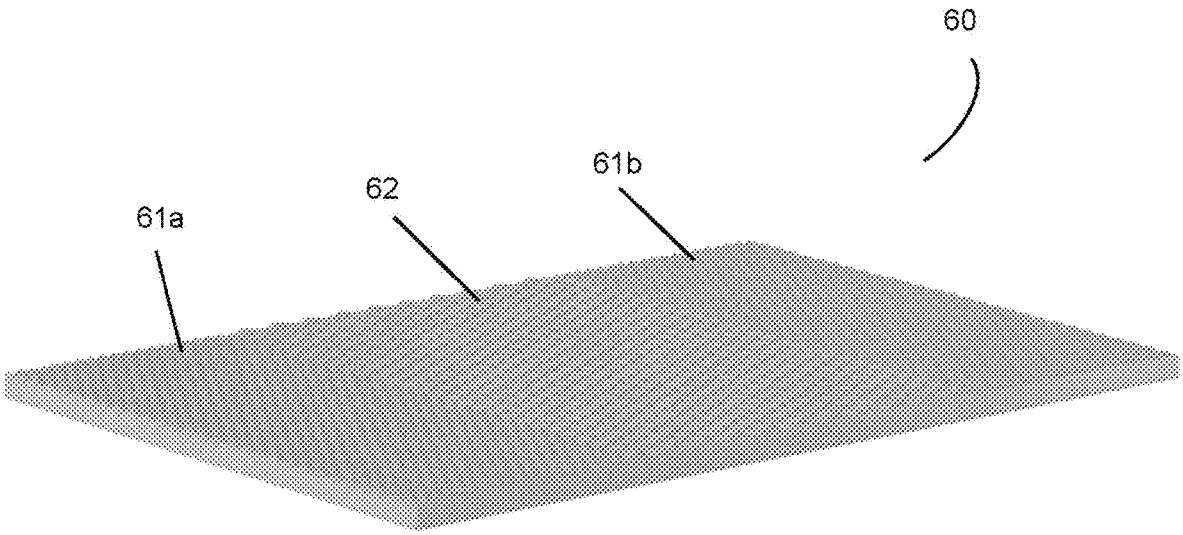
FIG. 6 is an isometric view of a tri-zone transition layer.

The second layer 40 and the fourth layer 42 are transition layers. In one aspect of the invention the transition layer is a tri-zone transition layer as shown in FIG. 6. The transition layers may be made of polyurethane open-cell foam. The transition layer transfers the shock between the comfort layers 18, 20, and the core layer 16. The second layer 40 may have a foam density between 1.5 and 3 lbs. In one aspect of the invention the foam density may be 1.65 lbs. The IFD of the second layer is about 20-25 lbs. In one aspect of the invention the IFD is 23 lbs.

In one aspect of the invention the fourth layer will be firmer than the second layer. Therefore, the mattress 12 can be flipped about its horizontal axis to allow a user to sleep on a soft side or a firm side. The fourth layer 42 may vary from the second layer 40 in that the IFD will be much greater. For example, in one aspect of the invention the IFD of the fourth layer may be 35-45 lbs. More specifically, in another aspect of the invention, the IFD may be 40 lbs. By varying the IFD between the two layers, it creates a varying feeling of firmness as a user lies on either side. It also allows the Foam Density to be the same on both layers. However, as appreciated by one skilled in the art, in some aspects of the invention the IFD could remain the same between the transition layers, and instead the density the height of the layer could be varied to affect the firmness. For example, the height of the fourth layer may be 1.5 inches while the height of the second layer is 2 inches.

The transition layers may be manufactured using Surface Modification Technology. Surface Modulation Technology carves out indentures across the entire layer to better support a human body. In one aspect of the invention both the transition layers 40, 42 may be designed as Tri-Zone layers, for example, as shown in FIG. 6. FIG. 6 shows a transition layer 60 having a first zone 61*a*, a second zone 62, and a third zone 61*b*. The surface modification technology may carve out a different pattern in each zone. In FIG. 6, a small diamond pattern is carved out in the first zone 61*a* and the third zone 61*b*. The diamond pattern creates valleys allowing cool air to enter the mattress while pushing hot air out. The second zone 62 is shown with a hexagon pattern which is designed to better support hips and shoulders. The hexagon pattern creates valleys allowing cool air to enter the mattress 12 while pushing hot air out. In addition to cooling the mattress, the surface modification technology also provides better support and can help prevent bed sores.

The firm layer 42 and the soft layer 40 may have different surface modification technology features. For example, the softer layer 40 may have the valleys cut deeper into the transition layer than the firm layer 42. For example, if the layer was 1.5 inches the soft layer may have patterns cut 0.5 inches into the polyurethane open-cell foam, while the firm layer 42 may have patterns cut 0.25 inches deep into the polyurethane open-cell foam. The compression caused by a human lying on the bed would push the softer layer 40, having a lower IFD, into a more compressed state, thus the valleys may need to be deeper to allow hot air to escape and maintain their other functions.

The core layer 16 may be comprised of a plurality of springs or coils. As appreciated by one skilled in the art cores may come in all different forms and general provide support for the mattress. The core layer 16 has a first side 24 and a second side 26. The sides do not necessarily perform differently based on whether they face the soft side of the firm side. The core also has a thickness 22. The thickness may allow for softer or firmer mattresses or may not have an affect on the firmness of a mattress. The thickness 22 may also be desirably small to make the mattress easier to fold, compress, or roll for ease in shipping. A core that can be compressed, folded, and rolled is advantageous for shipping costs.

Figure 7:
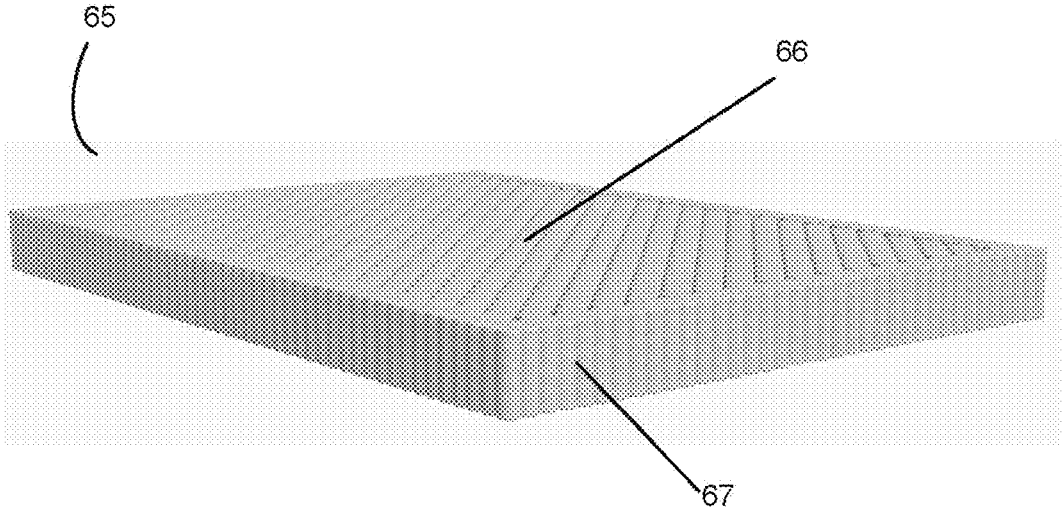
FIG. 7 is an perspective view of a core layer.

The core may be made from a plurality of different kinds of springs. In FIG. 7, the core 65 is shown with two zones. An outer zone 67 and an inner zone 66. The outer zone 67 may be of a higher gauge than the inner zone 66. The higher gauge of the outer zone 67 provides the mattress with superior edge support. Edge support may reduce or eliminate the feeling that you will roll-off your mattress and delivers a consistent sleep surface, even when foam layers are laid on top.

In one aspect of the invention, the outer zone 67 may be 16-gauge coils and the inner zone 66 may be 14-gauge coils. The higher gauge coils provide more resistance and thus create a flatter sleeping surface regardless of the sleeper's position. In one aspect of the invention each of the coils is individually wrapped. The individually wrapped coils prevent tangling, which allows the springs to move independently. By having independent movement in each spring, the mattress is able to resist bouncing along the entire sleeping surface of the mattress. This helps keep movement from transferring to the other side of the bed. Therefore, if two people are using the same mattress, the movement of one person will not resonate through the spring system and cause movement at the other side of the bed. Individually wrapped coils also allows for each wire to flex separately and therefore will conform to the individual contours of the body.

Coils also provide the mattress with a much cooler feel, as air is easily removed through the coils from the top and bottom foam layers. Coils also provide enough bend for adjustable bases, which causes less wear and tear on moving parts, making the mattress usable for a longer period of time. The wire that makes up the coils may also be heat-treated and stress relieved. This aids the coils in holding their shape and thus provides a more durable consistent sleep surface.

Coils may also be of varying buoyancy strategically designed to position comfort zones which support, for example, the hips, back, and shoulders. For example, having a nested center zoning would provide for more back support than a normal mattress. The high coil count in the center can also provide for an even surface across the entire mattress. Additionally, the coils may come pre-compressed. The pre-compressed coils create a firm surface that makes the unit more responsive to body movements.

Figure 4:
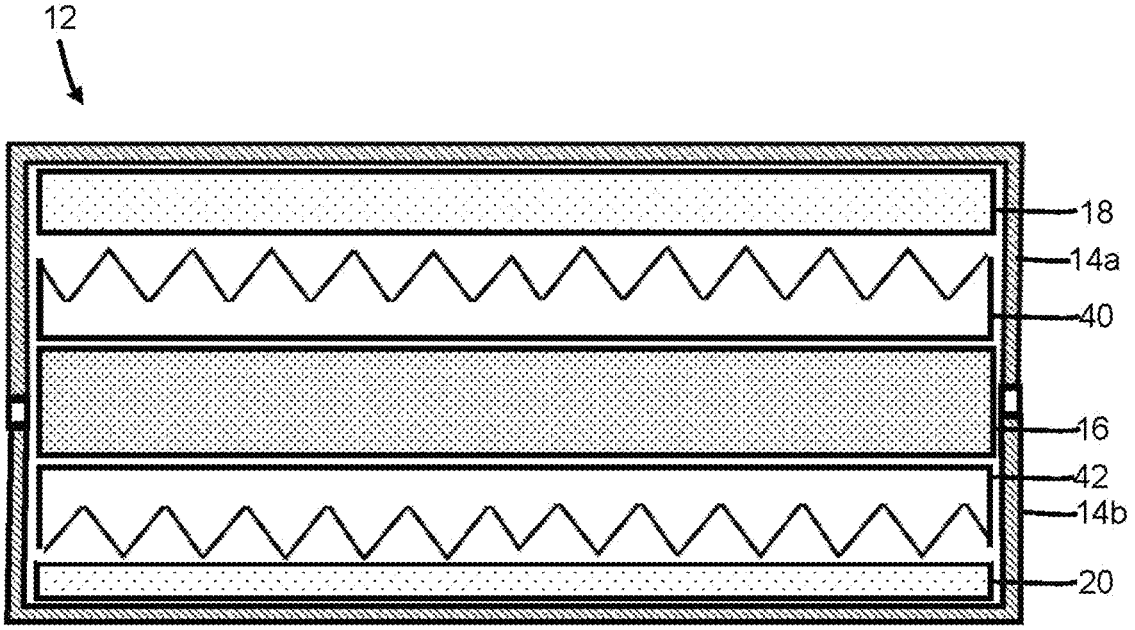
FIG. 4 is a cut-out view of the mattress soft-side up.
Figure 5:
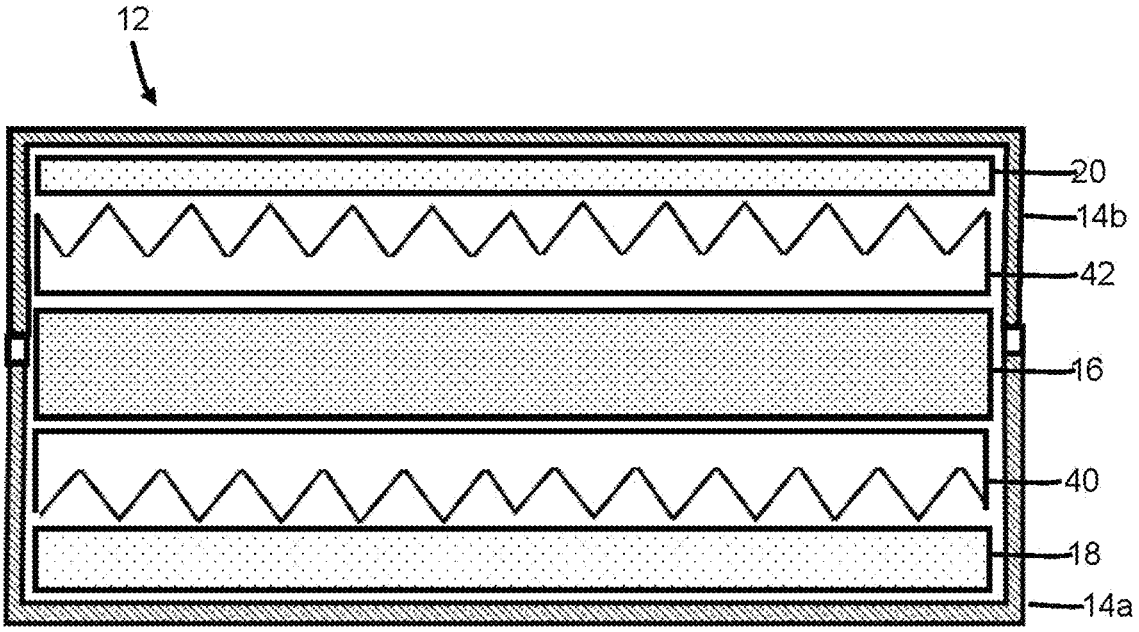
FIG. 5 is a cut-out view of the mattress firm-side up.

A cross-section of the mattress 12 is depicted in FIG. 4 and FIG. 5. In FIG. 4 the soft side is shown on top, whereas in FIG. 5, the firm side is shown on top. The layers may be fixed together via an adhesive (not shown). The adhesive may be a spray glue, or other adhesive as understood by one having ordinary skill in the art. The layers might also be held together via their location within the cover 14. In an aspect of the invention, the cover would provide enough tension throughout the layers to prevent them from sliding relative to each other. In some aspects of the invention the adhesive may only be applied to the edges of the layers, or even only to the vertical sides of the layers and affixed to the cover 14. In other aspects of the invention the adhesive could be applied over a larger surface of each layer, or of only selected layers.

The respective materials, thicknesses, and densities of the several layers of the mattress 10 also provide the mattress 10 with more than adequate support and stability, despite the fact that a memory foam layer is positioned at the bottom of the mattress 10 in both the first orientation (see the second memory foam layer 20 in FIG. 4) and the second orientation (see the first memory foam layer 18 in FIG. 5). The mattress 10 also achieves these significant advantages despite having a relatively low total thickness of 10.5 inches (i.e., approximately 26.7 cm), which is well within the range considered acceptable for use with typical bedframes.

As shown in FIG. 4 and FIG. 5, the transitional layers having shapes cut out are beneath the flat memory foam layers. This presents a flat surface to the sleeper while still providing the benefits of the surface modification technology. The core 16 is also positioned centrally to provide a benefit to the mattress regardless of what side is facing upwards. Therefore, it is important to have a reversible core 16. Since the foam layers provide the softness or firmness as may be desired it is not pertinent that the core provides a different firmness on either side. However, a core 16 that had a different firmness on either side would still be beneficial to the system.

Figure 8:
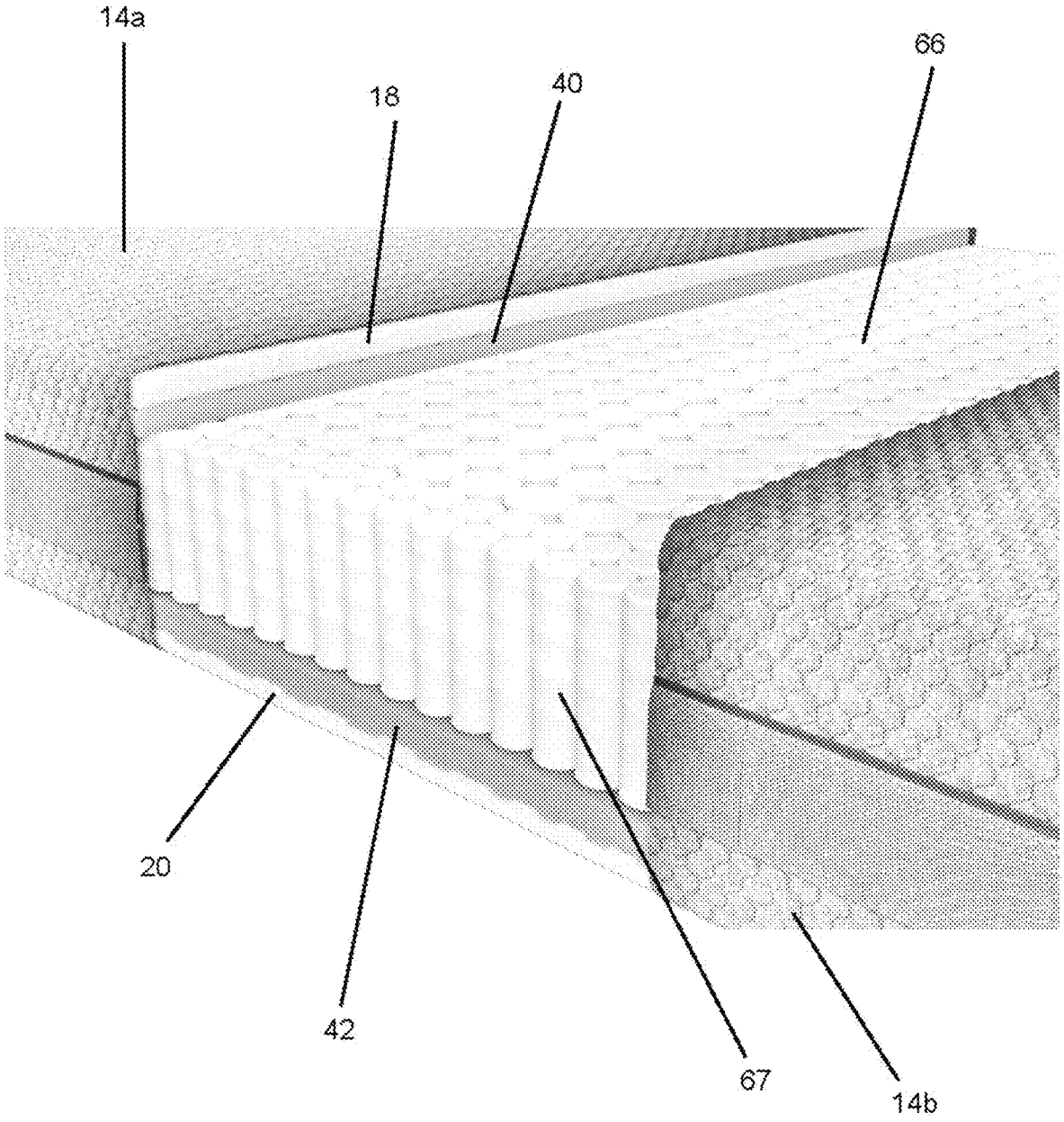
FIG. 8 is an perspective view of a cut-out of the mattress.
Figure 9:
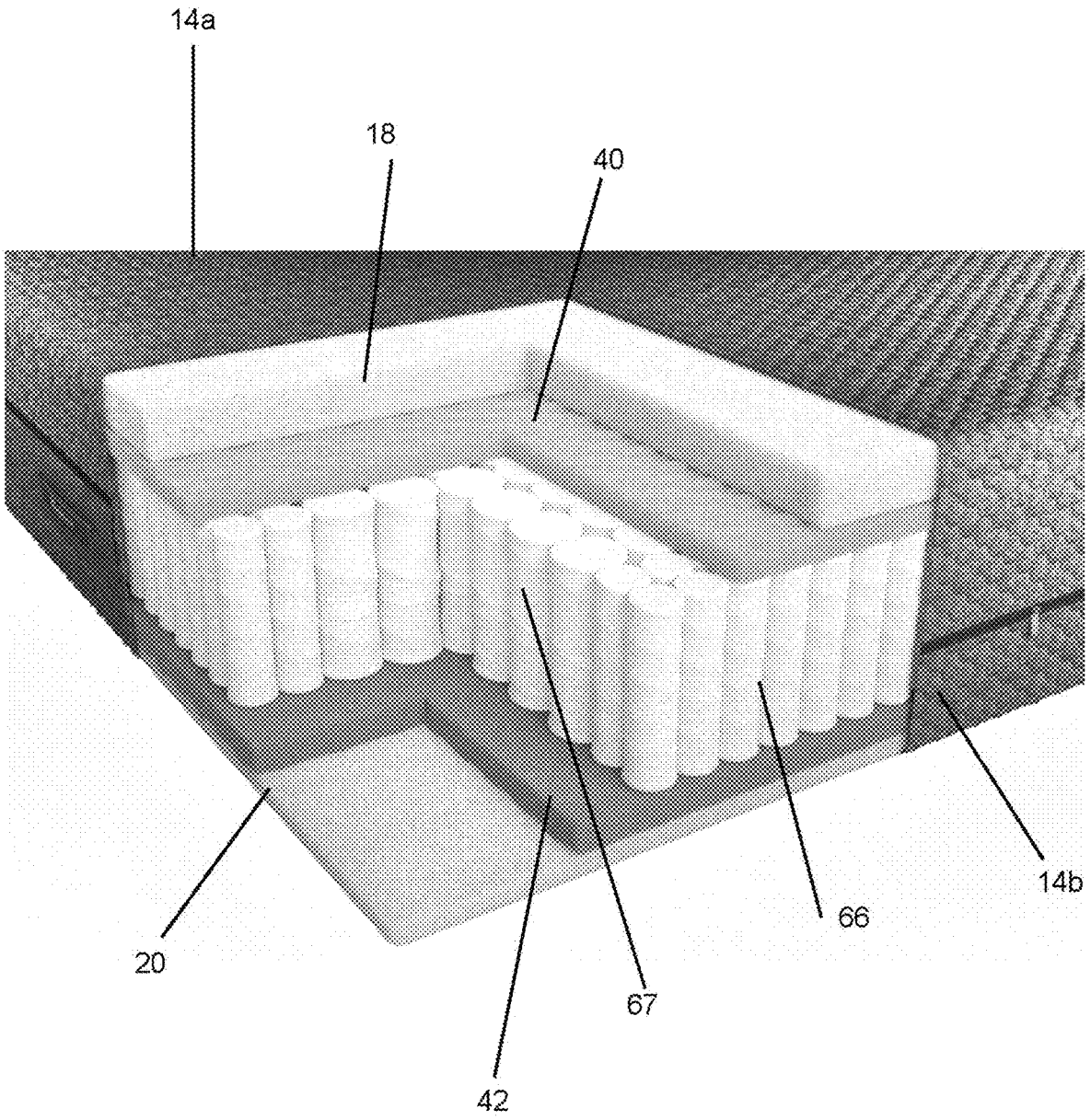
FIG. 9 is a perspective view of a cut-out of the mattress.

In FIGS. 8 and 9 the cover 14*a* and 14*b* is shown cut out to display the core layer 16. The core layer 16 is shown comprising a center core layer 66, and an outer core layer 67. The inner core layer 66 has springs with a longer diameter than the springs of the outer layer 67. The shorter diameter springs of the outer layer 67 provides a firm edge that helps prevent one from falling off the bed. The foam layers 18, 40 on top of the core layer 16 provide a softer feeling than the foam layers 20, 42 on the bottom of the core layer 16.

The cover 14*a*, 14*b* may provide a pinching effect on the layers to squish them all together and allow the foam layers to better push into the core. A looser fit of the layers may not translate the force from each layer to the next properly.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A flippable mattress comprising:

a first memory foam layer having a thickness;

a second memory foam layer having a thickness that is greater than the thickness of the first memory foam layer; and a cover;

wherein the mattress is flippable between a first orientation in which the first memory foam layer is above the second memory foam layer, and a second orientation in which the second memory foam layer is above the first memory foam layer;

wherein a first color pattern of the cover is on top when the mattress is in the first orientation and wherein a second color pattern of the cover is on top when the mattress is in the second orientation, wherein the mattress further comprises a core layer, said core layer comprising a plurality of springs wherein the mattress further comprises a first transitional layer between the core and the first memory foam layer;

wherein the mattress further comprises a second transitional layer between the core and the second memory foam layer;

wherein the transition layers have a first surface which is substantially planar and a second surface which has a pattern, wherein the second surface of the transition layers has a different pattern on the head and foot of the layer than in the center of the second surface of the transition layers.

2. The mattress of claim 1 wherein springs in an outer zone of the core layer are of a higher gauge than springs in an inner zone of the core layer.

3. The mattress of claim 1 wherein the first orientation provides a softer upper surface and the second orientation provides a firmer upper surface.

4. The mattress of claim 3 wherein the first color pattern is lighter on a grayscale than the second color pattern.

5. The mattress of claim 1 wherein in the first orientation a top lateral surface of the cover consists of a light gray hexagonal pattern and a bottom lateral surface of the cover consists of a darker gray hexagonal pattern.

6. A system, comprising:

a flippable mattress including:

a first memory foam layer having a thickness;

a second memory foam layer having a thickness that is greater than the thickness of the first memory foam layer;

a core layer between the first memory foam layer and the second memory foam layer;

a first transitional layer between the core and the first memory foam layer;

a second transitional layer between the core and the second memory foam layer;

wherein the mattress is flippable between a first orientation in which the first memory foam layer is above the core layer and the second memory foam layer, and a second orientation in which the second memory foam layer is above the core layer and the first memory foam layer; and a cover disposed on at least a portion of the mattress, wherein the transition layers have a first surface which is substantially planar and a second surface which has a pattern of repeated peaks and valleys, wherein the second surface of the transition layers has a different pattern on the head and foot of the layer than in the center of the second surface of the transition layers.

7. The system of claim 6 wherein the cover includes a first cover portion having a first color and a second cover portion having a second color, the first color indicating a soft firmness and the second color indicating a firm firmness, wherein the first cover portion and the second cover portion are fastened to one another.

8. The system of claim 6 wherein the in an uncompressed state the first memory foam layer has a thickness of 1 inch, the second memory foam layer has a thickness of 2.5 inches, the core layer has a thickness of 6 inches, and the transition layers have a thickness of 1.5 inches.

9. The system of claim 6 wherein the pattern on the head and foot of the second surface of the transition layers is a repeating diamond pattern and the pattern in the center of the second surface of the transition layers is a repeating hexagonal pattern.

10. The system of claim 7 wherein the cover further comprises handles on a long vertical side of the mattress.

11. The system of claim 6 wherein the core layer is a plurality of individually wrapped springs.

12. The system of claim 11 wherein the individually wrapped springs along the perimeter have a high gauge than individually wrapped springs in the center of the core layer.

13. The system of claim 6 wherein the flippable mattress is rollable and foldable.

14. The system of claim 6, further comprising:

a handle attached to a secondary fabric, wherein the secondary fabric is integrated into the cover.

15. The flippable mattress of claim 14 wherein the handle is vinyl.

16. The flippable mattress of claim 14 wherein the secondary fabric is non-stretchable and wherein the cover is stretchable.

* * * * *